US006241289B1

(12) United States Patent
Külper et al.

(10) Patent No.: US 6,241,289 B1
(45) **Date of Patent: *Jun. 5, 2001**

(54) LASER LABELS AND THEIR USE

(75) Inventors: Klaus Külper, Pinneberg; Arne Koops, Hamburg, both of (DE)

(73) Assignee: Beiersdorf AG, Hamburg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/173,373

(22) Filed: Oct. 15, 1998

(30) Foreign Application Priority Data

Oct. 24, 1997 (DD) ..... 197 47 000

(51) Int. Cl.[7] ..... B42D 15/00

(52) U.S. Cl. ..... 283/86; 283/114; 283/91; 283/81; 283/109

(58) Field of Search ..... 283/86, 87, 92, 283/109, 81, 114, 101; 428/40.1, 40.8, 41.6, 42.1, 423.1; 106/31.15, 31.32, 31.64

(56) References Cited

U.S. PATENT DOCUMENTS

| | | | | |
|---|---|---|---|---|
| 4,082,873 | | 4/1978 | Williams | 428/40 |
| 4,824,144 | * | 4/1989 | Tasma | 283/87 |
| 4,837,061 | * | 6/1989 | Smits et al. | 428/40 |
| 5,000,810 | * | 3/1991 | Silverstein | 156/238 |
| 5,062,928 | * | 11/1991 | Smith | 204/15 |
| 5,401,346 | * | 3/1995 | Yin et al. | 283/86 |
| 5,554,842 | * | 9/1996 | Connell et al. | 235/491 |
| 5,626,966 | * | 5/1997 | Kulper et al. | 428/423.1 |
| 5,702,805 | * | 12/1997 | Yin et al. | 428/195 |
| 5,759,671 | * | 6/1998 | Tanaka et al. | 428/186 |
| 5,868,432 | * | 2/1999 | Mantegazza | 283/92 |

FOREIGN PATENT DOCUMENTS

| | | |
|---|---|---|
| 27 48 498 | 5/1978 | (DE) . |
| 0 688 678 | 5/1995 | (EP) . |

* cited by examiner

*Primary Examiner*—Willmon Fridie, Jr.
(74) *Attorney, Agent, or Firm*—Norris McLaughlin & Marcus

(57) ABSTRACT

Laser labels comprising:

a) at least one polymer layer;

b) a self-adhesive composition coated on one side of said at least one polymer layer;

c) a printing ink applied by printing between said self-adhesive composition and said at least one polymer layer; and d) optionally a release paper or release film covering said self-adhesive composition; are useful for anti-counterfeit marking. The printing ink can be printed on the polymer layer before the self-adhesive composition is applied to the polymer layer.

2 Claims, 1 Drawing Sheet

LASER LABELS AND THEIR USE

BACKGROUND OF THE INVENTION

1. Field of the Invention

The present invention relates to laser labels and their use for anti-counterfeit marking.

2. Description of Related Art

Technical labels are employed in numerous sectors for high-grade applications—for instance, as model identification plates for vehicles, machines, electrical and electronic appliances, as control labels for process sequences, and as badges of guarantee and testing. In numerous instances these applications automatically entail the need for a greater or lesser degree of security against counterfeiting. This counterfeiting security applies primarily for the period of application and for the entire duration of use on the part to be labelled: removal or manipulation should, if possible at all, entail destruction or visible, irreversible alteration. In particularly sensitive fields of application there must be a security stage for the production of the labels as well: if the acquisition and marking of such labels were too easy, and if imitations were produced, unauthorized persons would be given the possibility of improperly trafficking in the articles concerned.

For the rational and variable production of high-grade labels, especially in technoindustrial applications, the laser marking of suitable base material is becoming increasingly more established. DE U 81 30 861.2 describes a multilayer label in which a top layer differing in colour is removed by the laser beam and, as a result, the contrast in colour with the adjacent layer permits inscriptions of high quality and legibility. Such an inscription constitutes a type of gravure, but removes the possibilities for manipulation associated with traditional printing with inks. DE U 81 30 861.2 entails the label film being rendered so brittle, by means of the raw materials employed and the production process, that it is impossible to remove the bonded labels from their substrate without destroying them.

An additional security stage is described in the single-layer laser label of DE U 94 21 868: here, in addition to the advantageous properties of DE U 81 30 861.2, the inscription is brought about not by gravure in the top layer but by a change in colour in the polymer layer itself, thereby very substantially preventing subsequent manipulation of the inscriptions.

Consequently, the only potential missing link in the security chain is that such single-layer and multilayer labels are freely available for laser inscription—for goods of appropriately high value, therefore, the acquisition of the labels and their inscription, even with expensive laser equipment, might be regarded as possible and rewarding.

In order to close the chain it was the aim of the development to configure the material from the which the labels are made in such a way, for their subsequent inscription, that such material can be identified at any time, with little effort and no destruction, as authentic, original material. For the laser labels which have already been specified, subsequent identification, although possible in principle, is nevertheless bound up with unacceptable analytical effort and is destructive.

Diverse techniques of ensuring security against counterfeiting are known for particularly security-relevant products, such as bank notes, cheques, cheque cards and personnel ID cards, inter alia. In addition to water marks, printing with intricate patterns, and application of holograms, "invisible" markings are also occasionally employed.

JP 08/1328474 describes a textile clothing label which is printed on its top face with a transparent, fluorescent ink, it being intended for the woven design and the printed image to be approximately identical in overlap. A similar surface printing with UV-active, photochromic inks is described in WO 88/01288; in order to protect the chemicals, however, this ink layer requires an additional layer for protection against oxygen and water.

In FR 2734655 a security marking on cheques is achieved in that, in part, the printing under a layer which is permeable only to IR is invisible in the visible wavelength range but can be read/identified mechanically with special IR light.

EP 727316 achieves hidden security against counterfeiting by providing, in an extra layer, especially on paper, two reactive components which give a colour reaction under pressure—this reaction, however, is irreversible.

The use of electroconductive and/or magnetic inks for surface printing is described in JP 08/1054825 and CN 1088239. For label applications on complex metal parts, such as vehicle and machine components, for example, the fitness of such systems for use is extremely limited.

The ink ribbons with fluorescent particles described in JP 07/164 760, which can be excited by IR, are transferred by means of heat, with thermal transfer printers. Although it is true that the prints constitute a hidden sign of originality, the printing is applied superficially and can be altered or removed with solvents, with heat or else mechanically.

DE 4231800 describes labels which for security against counterfeiting leave irremovable traces on the bonding substrates by means of supplimation inks or corrosive substances—in order to identify the traces, however, it is first necessary to remove the label, which is in many cases undesirable if not impossible.

For high security papers such as passports, shares, bank notes, etc., EP 453131 describes the incorporation into an interlayer between two permanently bonded plies of paper, along with the laminating adhesive, of fluorescent, especially UV-fluorescent, indicators which are detectable only on transmission of light of appropriate wavelength through the laminate but not by reflection under incident light. This system is unsuited to applications where transmission of light through the bonded label is impossible, and for the totally opaque laser labels.

All of these methods are applied superficially or are effective superficially and are therefore useful only to an extremely restricted extent if at all for the known laser labels, since in this case the surface of high optical quality and extreme resistance used, for example, for model identification plate applications would be altered and impaired. Such a modification would be particularly disruptive to the two-layer labels with high-gloss black top layer and white base layer that may be regarded as the technical standard for model identification plates. In addition, the means of security against counterfeiting that are known from the prior art and are applied superficially and subsequently carry with them the potential for manipulation to be carried out mechanically or using heat, chemicals, etc.

SUMMARY OF THE INVENTION

The object of the present invention was therefore to incorporate a substantially "invisible" additional security stage into the material from which the labels are made in order that originality can be proved rapidly, nondestructively and with a minimum effort. This invention has been realized by way of example for the laser-markable labels but can readily be transferred by the skilled worker to similar problem cases, such as printed labels, self-adhesive tapes and the like.

This object is achieved by a laser label as is characterized in more detail herein. Specifically, the present invention relates to laser labels comprising at least one polymer layer which is coated on one side with a self-adhesive composition, which is in turn optionally covered with a release paper or a release film, characterized in that a printing ink is applied by printing between the polymer and the self-adhesive composition.

BRIEF DESCRIPTION OF THE DRAWING

The invention will now be described in more detail with reference to the drawing, wherein.

DETAILED DESCRIPTION OF THE INVENTION

Figure 1:
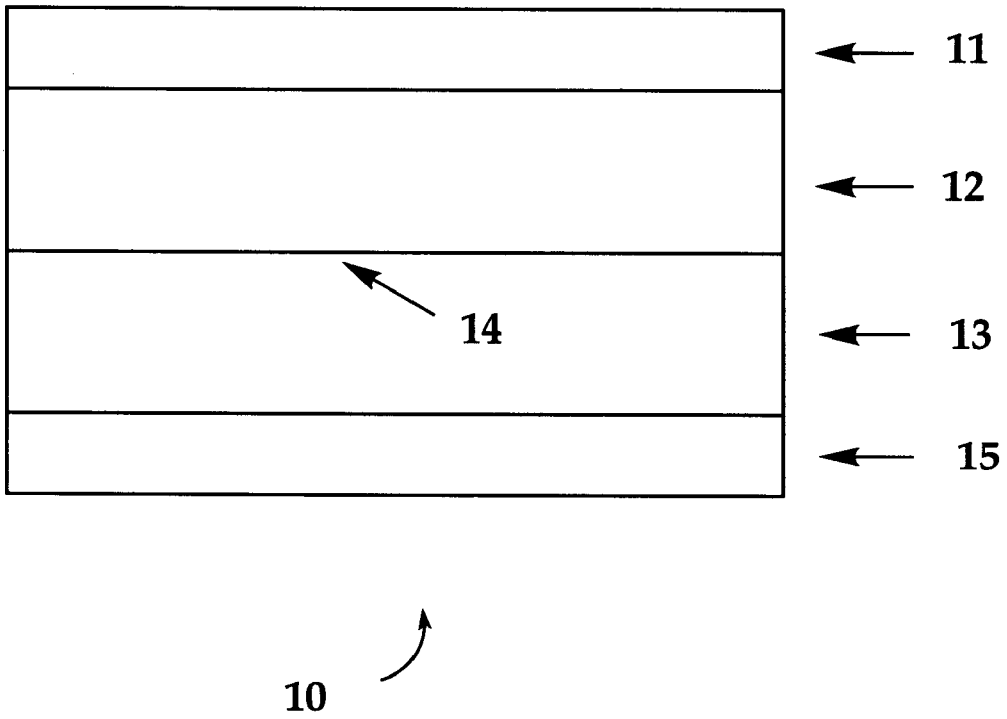
FIG. 1 is a schematic drawing depicting a laser label according to the invention.

As a solution to the problem discussed above, a way has been found, in particular, which makes it possible to incorporate a customer-specific security mark at the stage of the material from which the label is made and to do so in a variable and cost-effective manner: especially when using the standard label film in accordance with DE U 81 30 861.1 or DE U 94 21 868 or the like, a printing operation is carried out on the reverse of the film prior to coating with adhesive composition. This is carried out in particular using special printing inks comprising luminescent substances, daylight fluorescent colours or, in particular, by means of colour pigments which can be excited by IR or UV radiation. Following this printing operation, the resulting material is conventionally coated with self-adhesive composition, dried and lined with release paper.

A variety of colour pigments and dyes can be employed for the application of the invention. The most widespread are long-afterglow (phosphorescent) or fluorescent pigments, which are excited solely or predominantly by UV radiation and which emit in the visible region of the spectrum (for an overview see, for example, Ullmanns Enzyklopädie der technischen Chemie, 4th Edition, 1979, Verlag Chemie). IR-active luminescent pigments are also known. Examples of systems with UV fluorescence are xanthenes, coumarins, naphthalimides, etc., which in some cases are referred to in the literature under the generic term 'organic luminophores' or 'optical brighteners'. The addition of a few percent of the luminescent substances concerned is sufficient, incorporation into a solid polymer matrix being particularly favourable in respect of luminosity and stability. Examples of formulations which can be employed are those with RAD-GLO® pigments from Radiant Color N.V., Netherlands, or Lumilux® CD pigments from Riedel-de Haen. Also suitable are inorganic luminescent substances; as long-afterglow substances, especially with emission of light in the yellow region, metal sulphides and metal oxides have been found favourable, mostly in conjunction with appropriate activators. These compounds are obtainable, for example, under the trade name Lumilux® N or, as luminescent pigments improved in terms of stability, luminosity and afterglow persistence, under the trade name LumiNova® from Nemoto, Japan.

Also suitable in principle are luminescent substances which are excited by means of electron beams, X-rays and the like, and also thermochromic pigments, which change colour reversibly when the temperature is altered; the use of electrically conductive inks is also possible—in these cases, however, identification on the bonded label becomes inconvenient in practice and more complex than visualization by means of light of appropriate wavelength.

When selecting the colour pigments care should be taken to ensure that they are sufficiently stable for the subsequent process of producing the labels (e.g. adhesive coating) and do not undergo any irreversible change under the processing conditions (possibly thermal drying, electron-beam or UV curing, and the like). It is advantageous for long-term applications of the labels that these luminescent substances, the majority of which are sensitive, are embedded in a polymer matrix and are protected in addition by the colour film.

This additional marking cannot be seen from the front face in the region of the laser marking (except when the layer is transparent or translucent) but only all round the label at the edge. In order to ensure clear perceptibility at the label edge, strongly luminescent colour pigments are printed in a sufficient film thickness—nevertheless, the additional security mark is hidden and therefore not obvious. This security marking is protected against external access, since the print lies embedded between the label film and the adhesive layer: there is no risk of subsequent manipulation since it is impossible to detach the known laser labels without destroying the coated film.

Customer-specific "fingerprinting" of the labels can be brought about by a printed application of different colours or patterns. Regular patterns of lines and strokes in particular allow characteristic patterns of points of luminescence to be produced at the edges of the label and are, moreover, particularly sparing in terms of materials and finances. Following the punching or laser cutting of the label and its application to the substrate, a pattern of characteristic colours and geometries can be perceived at the edge of the label when an appropriate source of illumination is chosen.

The advantage of this security marking is manifested in particular in terms of logistics and costs: commercial printing inks and non-specific label film material can be employed and yet the said material can otherwise be produced in a customer-specific manner. Since such standard material, however, is used by label manufacturers only as an intermediate even for their own production and is not freely available on the market, however, there is no possibility of unauthorized access. In addition, small batch sizes and short delivery times are possible.

On the side of the polymer that faces away from the self-adhesive composition, there may be applied a further polymer layer which is partially removable by means of laser radiation, said further polymer layer consisting in particular of an electron-beam-cured coating film whose thickness is 1–20 $\mu$m and whose color contrasts with that of the underlying layer.

In the embodiment according to the invention use is made, for example, of the two-layer film material described in DE U 81 30 861.1. Prior to coating and lining with release paper, however, the reverse face is printed over its entire area in scattering printing or, in particular, with defined geometries. Printing inks with a high proportion of luminescent pigments are preferably applied by screen printing in order to obtain film thicknesses in the range of 0.5–50 $\mu$m, preferably 2–25 $\mu$m. After coating it with adhesive and lining it, the material from which the labels are made is punched to the desired formats and sizes or cut out by means of laser beam. These labels in the bonded state show no sign of a hidden anti-counterfeiting stage provided that luminescent substances are chosen whose light emission is generated by excitation with light outside the visible range; only after irradiation with appropriate light sources do the luminescent pigments become excited at the edges of the label. Here and here only, therefore, is it possible to perceive, visually, marks which give rise to a predetermined pattern of points of luminescence. By means of different widths and heights of stroke it is possible to vary the size of the points of luminescence. By this means it is possible—simply, cost effectively and, if required, in a customer-specific manner—to realize a readily detectable security stage via the selection of geometry and colour.

Labels of this kind can be identified rapidly and easily following application; apart from an appropriate light source, usually a UV lamp, and possibly a protective shield to shield out the ambient light, which is disruptive to the viewer, no special equipment is necessary. Following the examination, the label is retained unchanged in its previous function.

EXAMPLE 1

As described at length in DE U 81 30 861.2, and as depicted in FIG. 1, the two-layer laser label 10 of the invention is produced from a thin black top layer 11 and from a thicker, white base layer 12; prior to the coating of the white side 14 of the coated film with self-adhesive composition 13, customer-specific security markings are applied by screen printing to this side. The ink chosen is a UV screen printing ink prepared to the following formulation:

| | |
|---|---|
| 10% by weight | UV-tronic HM luminescence paste 806.025 |
| 90% by weight | Bargoscreen UV series 78-2 "transparent" |

(both ink components from SICPA Druckfarben GmbH).

The two components are mixed thoroughly, and 2% of UV-tronic initiator 806.330 is added. Printing takes place with a Gallus screen printing unit and a Screeny DW screen (ink film thickness about 40 $\mu$m, with a resolution of 300 $\mu$m). The print is made in a linear pattern and is cured using a commercially customary UV lamp. Coating with a polyacrylate pressure-sensitive adhesive composition at 50 g/m$^2$ and lining with a commercially customary silicone paper 15 produce the label starting material for further, customer-specific uses.

The desired label formats are obtained by punching or laser cutting of sheet or roll product—when the label is irradiated with a UV lamp [wavelength maximum at about 350 nm] bluish points of luminescence become visible at the edges of the labels, where the lines applied by printing meet the cut edges. Characteristic sequences of points arise depending on the chosen linear pattern. For clear recognition, it is useful to have a shield to shade out ambient light from the area of the label.

EXAMPLE 2

As Example 1 but replacing the above screen printing ink by a formulation composed of

| | |
|---|---|
| 10% by weight | UV-tronic HM luminescence paste 806.025 |
| 90% by weight | Bargoscreen UV series 78-2 "white" |
| with 2% | UV-tronic photoinitiator 806.330 |

(all ink components from SICPA Druckfarben GmbH).

Instead of printing with a linear pattern, printing is carried out over the entire area, so that after the desired label formats have been punched out a luminescent line is visible all round the label at the cutting/punching faces, under appropriate UV irradiation.

What is claimed is:

1. A laser label comprising:

A. at least one polymer layer;

B. a self-adhesive composition coated on one side of said at least one polymer layer;

C. a further polymer layer on a side of said at least one polymer layer facing away from said self-adhesive composition, said further polymer layer comprising an electron-beam cured film having a thickness of 1–20 $\mu$m, said further polymer layer being partially removable by laser irradiation and having a color which contrasts with a color of said at least one polymer layer;

D. a printing ink applied by printing between said self-adhesive composition and said at least one polymer layer; and E. an optional release paper or release film covering said self-adhesive composition.

2. A method for applying a laser label to a surface as an anti-counterfeiting measure that comprises applying the laser label according to claim 1 to a surface.

* * * * *

UNITED STATES PATENT AND TRADEMARK OFFICE

CERTIFICATE OF CORRECTION

PATENT NO. : 6,241,289 B1 
DATED : June 5, 2001
INVENTOR(S) : Klaus Kulper and Arne Koops It is certified that error appears in the above-identified patent and that said Letters Patent is hereby corrected as shown below:

Title page,
Item [56], References Cited, U.S. PATENT DOCUMENTS,
change the date from "9/1996" to -- 5/1997 --;
change the date from "12/1997" to -- 6/1998 --
OTHER DOCUMENTS, add -- Muller, Kriminalistik, pages 211, 222-225 (May 1979)

Signed and Sealed this

Sixteenth Day of September, 2003

JAMES E. ROGAN
*Director of the United States Patent and Trademark Office*